United States Patent [19]

Golkar

[11] Patent Number: 4,836,367

[45] Date of Patent: Jun. 6, 1989

[54] COMPARTMENTED FOOD CONTAINER WITH HANDLED PARTITION

[76] Inventor: Homayun Golkar, 9041 Pacific, #4, Anaheim, Calif. 92804

[21] Appl. No.: 139,902

[22] Filed: Dec. 31, 1987

[51] Int. Cl.[4] ..... B65D 5/46; B65D 5/48

[52] U.S. Cl. ..... 206/200; 206/162; 206/172; 206/549; 229/52 B; 229/120.02; 229/120.38

[58] Field of Search ..... 206/541, 544, 545, 549, 206/162, 170–176, 178, 198–200, 427, 562, 563, 561; 229/120.02, 120.03, 120.07, 120.38, 41 R, 41 B, 28 BC, 23 R, 23 A, 902, 904, 906, 52 A, 52 B; 220/96

[56] References Cited

U.S. PATENT DOCUMENTS

| | | | |
|---|---|---|---|
| 2,446,161 | 7/1948 | Price | 206/172 |
| 2,719,665 | 10/1955 | Thorpe et al. | 229/52 A |
| 2,728,484 | 12/1955 | Farrington | 229/52 B |
| 3,257,027 | 6/1966 | Weiss | 206/200 |
| 3,355,012 | 11/1967 | Weiss | 206/200 |
| 3,384,224 | 5/1968 | Buchholz et al. | 229/52 B |
| 3,780,906 | 12/1973 | Katzenmeyer | 206/170 |
| 4,497,433 | 2/1985 | Wischusen | 206/562 X |

FOREIGN PATENT DOCUMENTS

| | | | |
|---|---|---|---|
| 525792 | 6/1956 | Canada | 229/52 B |
| 2249549 | 5/1975 | France | 229/52 B |
| 571355 | 8/1945 | United Kingdom | 229/52 B |

*Primary Examiner*—Bryon P. Gehman
*Attorney, Agent, or Firm*—Edward E. Roberts

[57] ABSTRACT

A food container formed from a first sheet of paperboard and a second sheet, preferably of an insulating material, the first sheet having side, end, bottom, and top wall portions, foldable relative to one another, and attachable at selected locations, to form an enclosure, with the second sheet thermally subdividing the enclosure to form two separated compartments therein. The second sheet lies in a plane generally perpendicular to the bottom of the container, with a handle portion of the second sheet coacting with a handle portion of the first sheet to provide a carrying handle for the container.

18 Claims, 3 Drawing Sheets

COMPARTMENTED FOOD CONTAINER WITH HANDLED PARTITION

BACKGROUND OF THE INVENTION

The background of the invention will be discussed in two parts.

1. Field of the Invention

This invention relates to food containers, and more particularly to a container for use with fast food service in which the container is formed of paperboard or sheet material and includes provision for multiple orders.

2. Description of the Prior Art

Fast food establishments, such as establishments which serve hamburgers, tacos and the like, along with beverages in disposable containers, have become prevalent. In such establishments, collapsible paperboard and/or preformed plastic containers are utilized, along with paper bags, for carry-out service. In the majority of instances, such containers have taken the form of open top bins, formed of paperboard, which are then used to carry different items, such as sandwiches and cold drinks.

In most instances, such carry out containers require the use of both hands, particularly when the container is formed somewhat as a tray. With paper bags, hot and cold foods occupy the same package space in close proximity.

In accordance with an aspect of the invention, it is an object to provide a new and improved food container, having separated compartments, and handle portions for carrying.

SUMMARY OF THE INVENTION

In accordance with a preferred embodiment of the present invention, there is provided a food container, formed of a first sheet of paperboard, and a second sheet, preferably of an insulating material, the first sheet having side, end, bottom, and top wall portions, foldable relative to one another, and attachable at selected locations, to form an enclosure, with the second sheet thermally subdividing the enclosure to form two separated compartments therein. The second sheet lies in a plane generally perpendicular to the bottom of the container, with a handle portion of the second sheet coacting with a handle portion of the first sheet to provide carrying means for the container.

The foregoing and other objects of the invention will become apparent from a reading of the specification, taken in conjunction with the drawings, wherein reference numerals in the specification refer to like elements in the several views of the drawings.

DESCRIPTION OF THE PREFERRED EMBODIMENT

Figure 1:
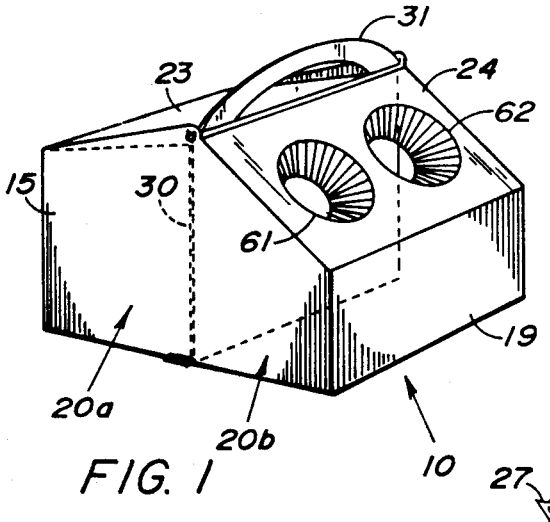
FIG. 1 is a perspective view of a food container in accordance with the invention, shown in its ready for use position.
Figure 2:
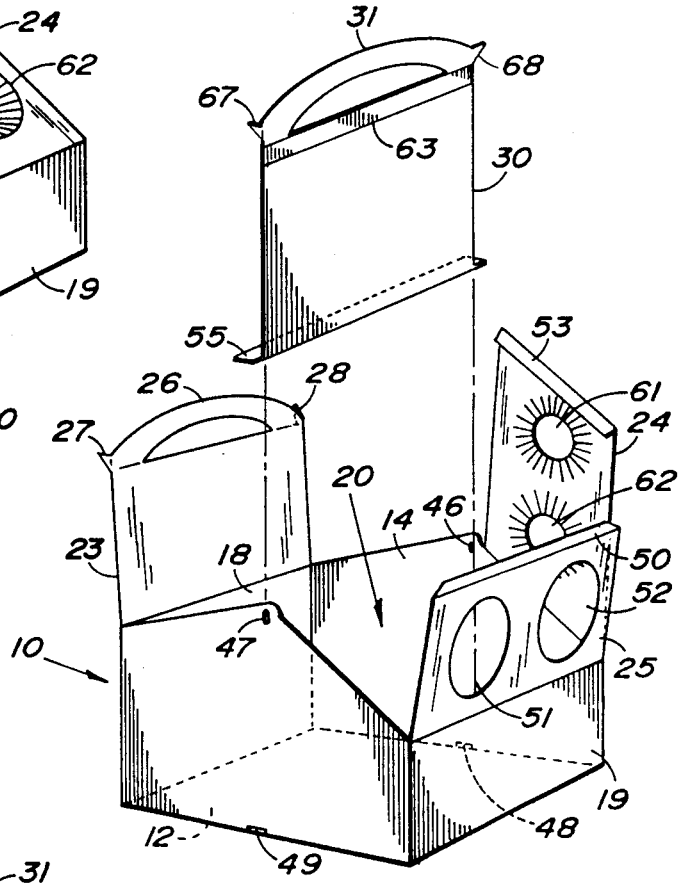
FIG. 2 is a perspective view of the food container of FIG. 1, with portions thereof opened for illustrating the various parts thereof.
Figure 3:
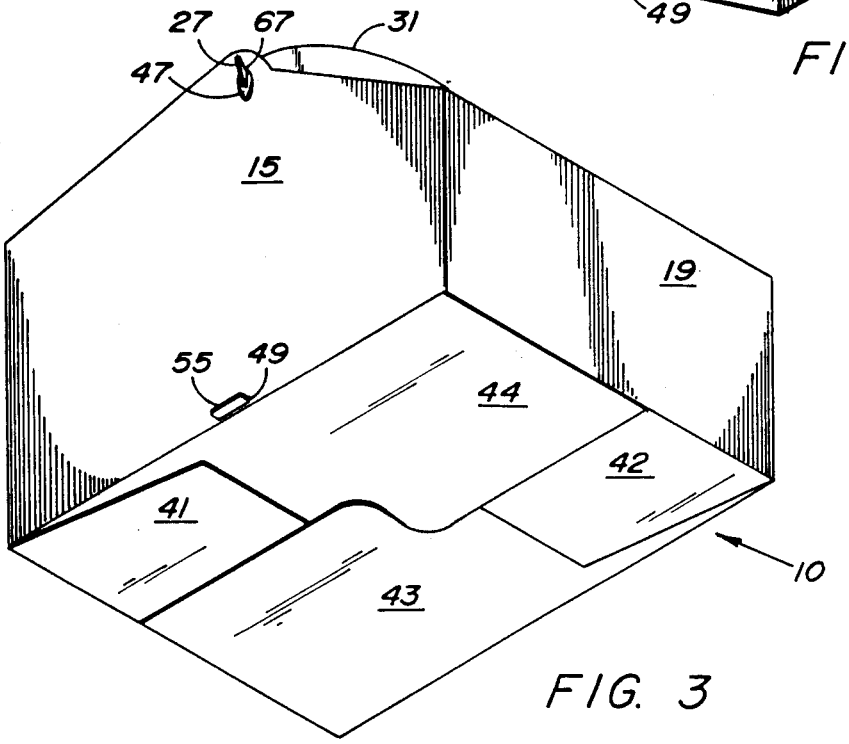
FIG. 3 is a bottom perspective view of the food container of FIG. 1.

Referring now to the drawings, and particularly FIGS. 1 through 3, there is shown a food container, generally designated 10, which includes a bottom, generally designated 12, side walls 14 and 15, and end walls 18 and 19, which define a food and drink receiving box-like enclosure, generally designated 20. A top cover is provided for the enclosure, in the form of inwardly foldable top portions 23–25. As shown in FIG. 1, two of the top portions 24 and 25 are configured for interoperatively overlapping relation to define first and second beverage container receiving openings 51, 52. A partition member 30, shown in dotted lines in FIG. 1 and in solid exploded relation in FIG. 2 divides the enclosure 20 into a food containing compartment **20*a* and a beverage receiving compartment 20*b*. As will be described the partition 30 serves as an insulation barrier between the two compartments 20*a* and 20*b***, and while it may be formed of paperboard, it is preferably formed of an insulating material such as styrofoam, or the like. With such fast food services, the food is normally hot or warm, while the beverage is usually an iced cola or shake or the like.

To facilitate transport of the container 10, a top portion 23 and the partition 30 are formed with integral handles 26 and 31, respectively, and with the dimensions of the part appropriately selected, the handles lie in abutting vertically disposed relation with the top portions 23, 24 and 25 closed (as shown in FIG. 1) to provide ready transport means for the container 10.

Figures 4, 5:
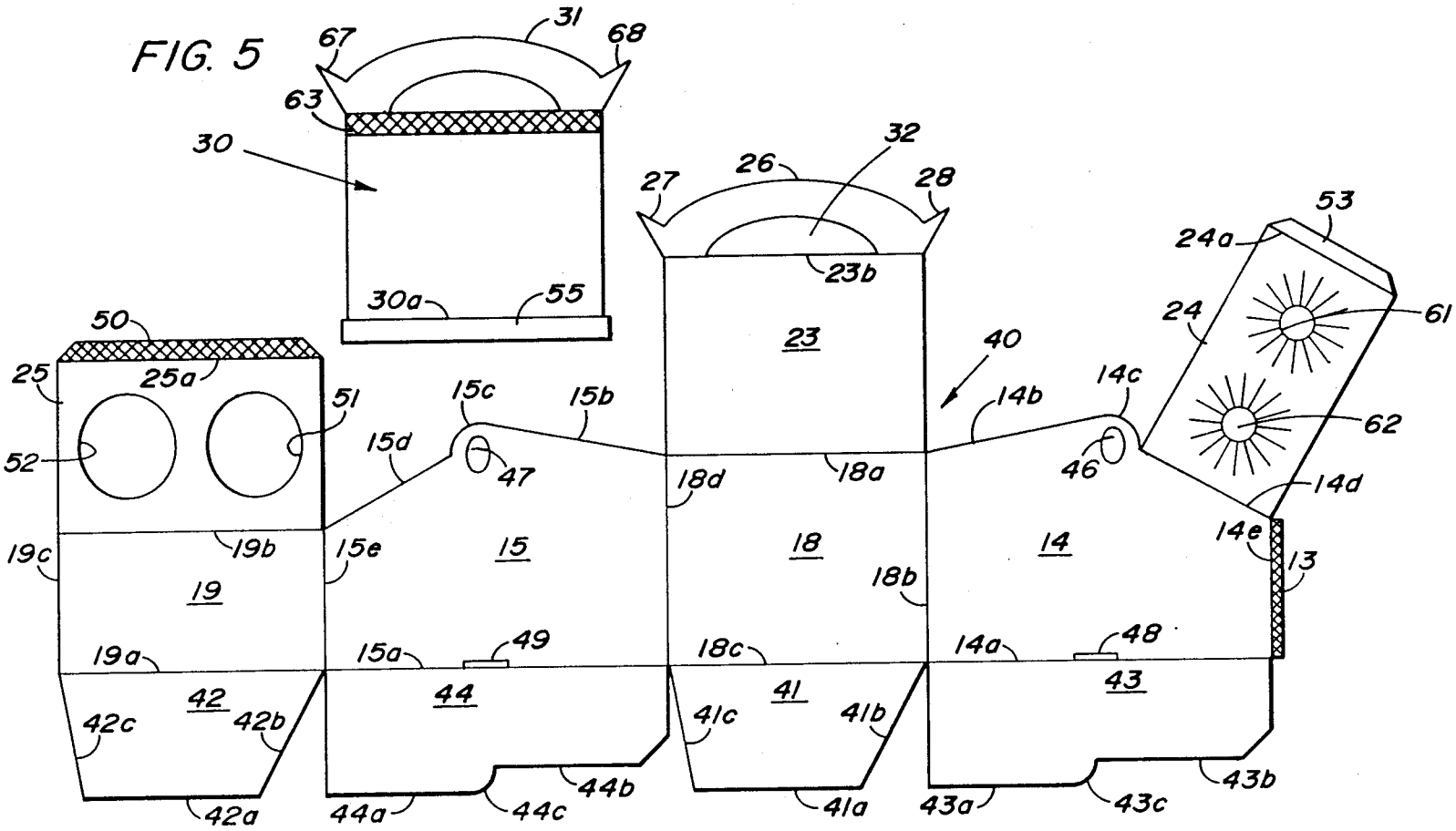
FIG. 4 is a plan view of a blank of a first sheet of a paperboard material used to form the enclosure of the food container of FIG. 1.
FIG. 5 is a plan view of a second sheet of insulating material which is used to divide the enclosure formed from the blank of FIG. 4 into two compartments to form the food container of FIG. 1.

Referring now to FIGS. 4 and 5, a blank, generally designated 40, is shown in FIG. 4 and is formed of a sheet of paperboard material, while a second sheet of material is used to form the partition 30 shown in FIG. 5. These two sheets are the total material requirement to form the container 10. The blank 40 is divided into sections which are defined by the outer periphery of the blank and the solid lines, which are fold lines, usually formed, such as by scoring or application of pressure with an edged tool.

The blank 40 is formed to provide a generally square first end wall 18, the outer edges of which are defined by fold lines **18*a*, 18*b*, 18*c* and 18*d*, with a top portion 23 contiguous with and sharing the fold line 18*a*. The top portion 23 has the same width as the end portion 18, with the length, that is the length in a vertical direction as shown in the drawings, being slightly longer. The upper edge of the top portion 23 is defined by a horizontal fold line 23*b*, part of which defines the lower edge of an opening 32, which is part of the handle 26. The upper peripheral edge of the handle 26 is arcuately configured to fit the hand. At the opposite ends of the handle portion 26, there are provided outwardly and upwardly extending protrusions 27 and 28**, which serve as tab projections for connecting portions together, as will be described.

The bottom 12 is formed of three interlocking flap portions 41–44, formed integrally as part of the blank 40, with bottom flap portion 41 extending downwardly from the end portion 18. Adjacent and contiguous to the end wall 18 are side walls 15 and 14, with side wall 14 having the fold line 18*d* as one edge thereof, and side wall 14 having the opposing generally parallel fold line 18*b* as an edge thereof. The side walls 14 and 15 have the bottom edges thereof in general alignment with the bottom of end wall 18, that is fold line 18*c*, with the lower edges of side walls 14 and 15 being defined by fold lines 15*a* and 14*a*, respectively, which are in alignment with one another and with fold line 18*c*.

The side walls 15 and 14 are generally identically configured in mirror image relation, with the upper peripheries thereof being somewhat angular. Side wall 14 has a rightwardly and upwardly angled edge 14*b* extending from the fold line 18*b* to the approximate center thereof, with an upwardly lobal protrusion 14*c*, followed by a downwardly and rightwardly angled line 14*d*, to which is integrally attached an edge of one of the top flap portions 24. The edge 14*e* of side wall 14 opposite fold line 18*b* is a fold line for an integrally formed narrow trapezoidally configured glue tab 13, which is dimensioned, configured and positioned for attachment to the inside edge of the edge 19*b* of the end wall 19. Upon folding of the vertical fold lines 18*b*, 18*d*, and 15*a* of the blank 40, and attachment of the glue tab 14*e*, a boxlike enclosure is obtained.

Similarly the side wall 15 has a corresponding edge 15*b*, a lobal portion 15*c* and another edge 15*d*, corresponding to parts 14*b*, 14*c* and 14*d*, respectively. The lobal portions 14*c* and 15*c* are at the approximate midpoint of the width of the side walls 14 and 15, with each containing an ovate aperture 46, 47, respectively therein for coaction with the interlocking protrusions 27 and 28 of handle 26. Disposed vertically below the apertures 46 and 47, within side walls 14 and 15, there are transversely extending slots 48 and 49, which lie along fold lines 14*a* and 15*a*, respectively, at the general midpoints thereof, and which, as will be described assist in securing partition 30.

The other end wall 19 has an edge thereof lying in contiguous relation with the side wall 15, with fold line 15*e* being shared by the two parts. The end wall 19 is an integral part of the blank 40, and is provided with lower and upper fold lines 19*a* and 19*b*, respectively, the lower fold line 19*a* being colinear with each of the other fold lines 15*a*, 18*c* and 14*a*. The end wall 19 is generally rectangular and slightly smaller in height than the opposing end is generally rectangular and slightly smaller in height than the opposing end wall 18. The top portion 25 is contiguous to the upper fold line 19*b* and generally rectangular in form with an upper fold line 25*a* defining the upper edge thereof, with a narrow generally trapezoidal glue tab 50 contiguous thereto, the glued surface opposite to the side shown in the drawing. The glue tab 50 is shown as cross-hatched, and includes a self-sticking non-moist adhesive layer.

The top portion 25 includes first and second beverage receiving container openings 51 and 52, which are spaced laterally relative to one another within the dimensions of the top portion 25. The coacting top portion 24 is interconnected with and contiguous to the sidewall 24, with an edge thereof along fold line 14*d*, the top portion 24 being of generally rectangular configuration with tab 53 (which may or may not be glued) along the edge thereof opposite the fold line 14*d*, with the top portion 24 having a fold line 24*a* defining the edge of the narrow tab 53.

The top portion 24 is provided with first and second beverage container receiving openings 61 and 62, positioned and configured for overlying coacting relation with openings 51 and 52, respectively, of top portion 25. The openings 61 and 62 are formed as smaller diameter openings with a plurality of radially extending slots about the circumference thereof to form a plurality of frictional finger means for engagement with the side of the beverage container upon insertion therein. Openings 51, 52, 61, and 62 are preferably configured in an oval shape with the long axis thereof in lateral relation to one another.

The bottom flap portions 41, 42, 43 and 44, have the upper portions thereof colinear with, and defined by, the fold lines 18*c*, 19*a*, 14*a* and 15*a*, of side wall 18, end all 19, side wall 14, and end wall 15, respectively. Flap portions 41 and 42 are generally identical and of a somewhat skewed trapezoidal configuration with the lower edges 41 and 42*a* parallel to the fold lines 18*c* and 19*a*, respectively. The angled edge 41*b* and 41*c* of flap portion 41 are at slightly different angles relative to the upper fold line 18*c*, with the edges 42*b* and 42*c* of flap portion 42 being likewise angled relative to fold line 19*a*.

The other bottom flap portions 43 and 44 are generally identical and provided with first lower edge portions 43*a* and 44*a*, which lie along a line through edges 41*a* and 42*a*. The flap portions 43 and 44 include second upwardly recessed edges 43*b* and 44*b*, which are colinear, generally parallel to the fold lines 14*a* and 15 and closer thereto. The edges 43*a* and 43*b* extend a distance of slightly less than one-half the width of the flap 43, with a rounded transition corner 43*c* between the two. The edges 44*a* and 44*b* are similarly configured and dimensioned with a transition corner 44*c*.

The partition 30, as shown in FIG. 5, has a generally rectangular body portion, with a lower fold line 30*a*, below which is a narrow integrally formed strip 55 having a width slightly greater than the width of the main body portion to form tab projections 55*a* and 55*b*, dimensioned and configured for being received within slots 48 and 49, as will be described. The width of the main body portion of partition 30 is generally equal to the width of the end walls 18 and 19. Intermediate the main body portion of partition 30 and the handle 31, there is a laterally extending glue strip 63, shown in crosshatching, which is positioned and dimensioned for adhesive affixation to the glue tab 50 of top portion 25, as will become apparent. The handle 31 is configured generally identically to handle 26 and includes a handle opening 59 and upwardly angled protrusions 67 and 68.

For assembly of the food container 10, by reference to the blank 40 of FIG. 4, the blank 40 is folded along the vertical (as shown in the drawings) fold lines 14*e*, 18*b*, 18*d*, and 15*a*, with the glue tab 13 affixed to the surface of the edge 19*c* of the end wall 19, to form a rectangular box-like opening. The bottom flap portions 41–44 are then interlocked until they are as shown in FIG. 3. At this point the container appears as shown in FIG. 2. The bottom strip 55 of the partition 30 is then folded until it is at right angles to the main body portion and the end tabs 55*a* and 55*b* are inserted into the lateral slots 48 and 49.

The protrusions 67 and 68 of the handle 31 are fitted into ovate openings 46 and 47, respectively. The partition 30 is inserted so that the glue strip 63 faces toward the end wall 19 for coaction with the glue tab 50 thereof. At this point, top portion 25 is then folded inwardly along fold line 19*b*, with fold line 25*a* creased to enable attachment of glue tab 50 to the glue strip 63. The other top portion 24 is then folded inwardly, with the fold line 24*a* bent until the glue tab 53 is at right angles to the plane of the top portion 24. The glue tab 53 is then affixed to the interior of the opposing side wall 15 adjacent the edge 15*d* thereof.

Figure 6:
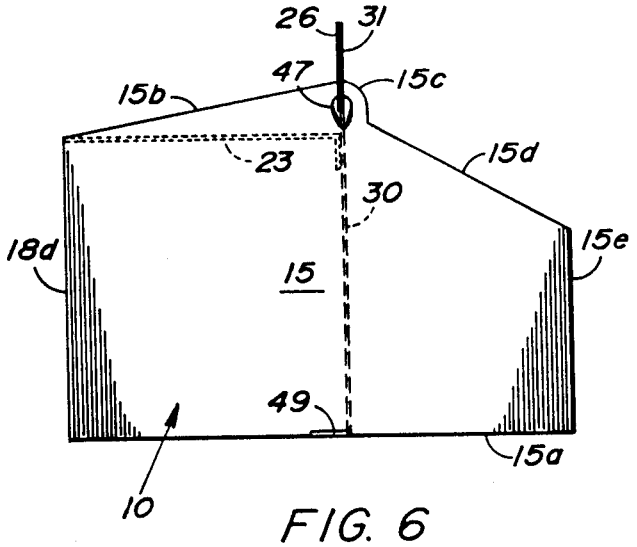
FIG. 6 is a side elevational view of the food container of FIG. 1.
Figure 7:
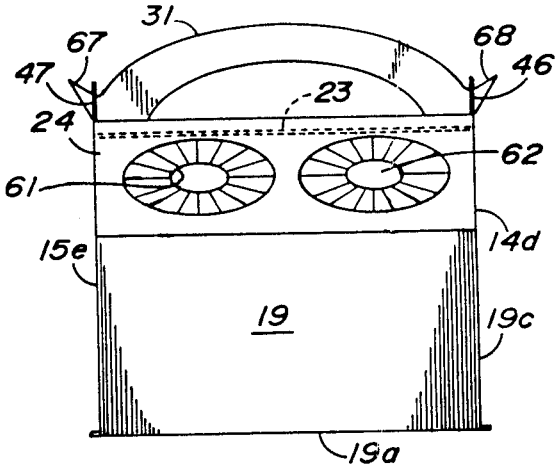
FIG. 7 is a a top plan view of the food container of FIG. 1.
Figure 8:
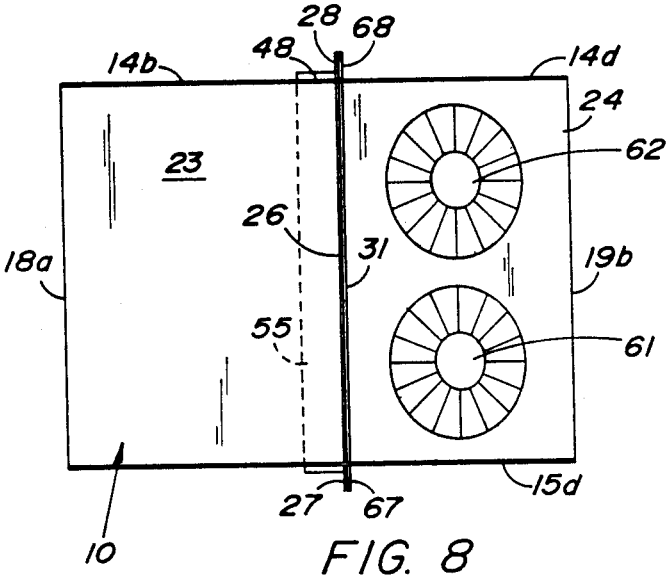
FIG. 8 is a front elevational view of the food container of FIG. 1.

At this point, enclosure 20 of food container 10 is divided into two compartments by the partition 30, with the beverage container receiving compartment essentially fixed in place, that is, it cannot be readily opened due to the adhesive fixation of the parts. The top portion 23 acts as a hinged lid for the other compartent, into which food is inserted, after which the handle 26 is bent along fold line 23*b*, the top portion 23 is then hinged along fold line 18*a* toward the center of the container 10, the protrusions 27 and 28 are inserted into the ovate openings 47 and 46, respectively, and the food and beverages are then readily transportable. As shown in FIG. 6, the top portion 23 is recessed below the edges 14*b* and 15*b* of the side walls 14 and 15, respectively, thus providing frictional retention of the opposing edges of the top portion 23 coacting with the interior surfaces of the sidewalls 14 and 15. The food container 10 in its closed position is illustrated in FIGS. 6 through 8. In this manner, the food is within a tightly enclosed compartment, the beverage containers are frictionally secured within the openings 61 and 62, which overlap the openings 51, 52. As desired, partition 30 may be formed of an insulating material, partially formed of an insulating material, or formed of the same overall container material.

With the partition 30 formed as an insulation barrier, the relative temperatures of the food and beverages are relatively unaffected by the proximity to one another. In addition, it is to be noted that the partition 30 lies along the vertical midpoint of the container 10 and facilitates carrying, while providing vertical structural support at this midpoint. The food container also serves as a ready container for trash which may be stored therein and conveniently discarded after use.

While there have been shown and described preferred embodiments, it is to be understood that various other adaptations and modifications may be made without depending from the spirit and scope of the invention.

What is claimed is:

1. A food container comprising:

a first sheet member formed in a blank of paperboard material and having a pair of side walls, a pair of end walls, a plurality of bottom portions and first, second and third top portions, foldable relative to one another, and attachable at selected locations, to form an enclosure, at least one of said top portions including a first handle portion ;

a second sheet member, of paperboard material and at least partially formed of an insulating material, having a first end means for attachment to the bottom of said enclosure and extending along a plane in a direction generally perpendicular to said bottom for forming two compartments within said enclosure, and having a second handle portion at a second end thereof for coaction with the said first handle portion of said at least one top portion for providing handle means for carrying said food container; and wherein two of said top portions are positioned for overlying relation, with at least one beverage container receiving opening formed in each of said two top portions, so that the openings are in aligned relationship upon overlying of the one top portion with the other.

2. The food container according to claim 1 wherein at least one of said two top portions includes means in said at least one beverage container receiving opening for frictional engagement with the side of a beverage container therein.

3. The food container according to claim 2 wherein there are two beverage container receiving openings in each of said two top portions.

4. A food container comprising a first sheet of paperboard material formed in a blank, said blank including:

(a) a first end wall of generally rectangular configuration;

(b) a first top cover portion contiguous with and foldably connected to said first end wall along the edge opposite the folding line for its respective bottom portion, said first top cover portion including first handle means for carrying said food container and oppositely disposed, generally outwardly extending tab portions;

(c) a pair of generally identical side walls in contiguous relation to opposite edges of said first end wall, and foldably connected thereto, each of said side walls including aperture means for receivably coacting with respective ones of said tab portions;

(d) a second generally rectangular end wall in contiguous relation to an edge of one of said side walls, the lower edges of each of said end walls and each of said side walls being colinear;

(e) a bottom flap portion connected in foldable relation to each of said end walls and side walls with the fold lines along said colinear line;

(f) a second generally rectangular top cover portion contiguous with and foldably connected to said second end wall along the edge opposite the folding line for its respective bottom portion;

(g) a third top cover portion contiguous with and foldably connected to one of said side walls along a portion of the edge generally opposite the folding line for its respective bottom portion, said third top cover portion having a rectangular configuration for coacting relationship with said second top cover portion; and (h) means on said blank for enabling attachment of said end walls, said side walls, said bottom flap portions, and said top cover portions at selected locations when folded relative to one another to form an enclosure with a bottom, said end walls, said side walls, said bottom flap portions, and said top cover portions being so dimensioned, configured and arranged that said second and third top cover portions overly one another to close a portion of said enclosure and said first top cover portion closes the other portion of said enclosure with said tab portions engaging said aperture means and with said handle means accessible for carrying said food container.

5. The food container of claim 4 wherein said second sheet member is formed of an insulating material.

6. The food container of claim 4 further including a second sheet member and wherein said second sheet member and said side walls include interlocking means for attachment of said second sheet member along a plane generally perpendicular to the bottom for dividing said enclosure into two compartments.

7. The food container of claim 6 wherein said second sheet member includes second handle means for carrying said food container with tab portions configured for engagement with said aperture means in said side walls and wherein said interlocking means includes tab means on said second sheet member for engagement with slot means in said side walls adjacent the bottom thereof.

8. The food container of claim 6 wherein said second sheet member includes second handle means for carrying said food container so dimensioned that said second handle means of said second sheet member is in abutting relation with the said first handle means of said first top cover portion when folded to close the enclosure.

9. The food container according to claim 4 wherein said means for enabling attachment includes glue tab means on said second and third top cover portions and an edge of one of said side walls.

10. The food container according to claim 4 wherein said means for enabling attachment includes interlocking edges on said bottom portions.

11. A food container comprising a first sheet of paperboard material formed in a blank, said blank including:

(a) a first end wall of generally rectangular configuration;

(b) a pair of generally identical side walls in contiguous relation to opposite edges of said first end wall, and foldably connected thereto;

(c) a second generally rectangular end wall in contiguous relation to an edge of one of said side walls, the lower edges of each of said end walls and each of said side walls being colinear;

(d) a bottom flap portion connectd in foldable relation to each of said end walls and side walls with the fold lines along said colinear line;

(e) a first top cover portion contiguous with and foldably connected to said first end wall along the edge opposite the folding line for its respective bottom portion;

(f) a second top cover portion contiguous with and foldably connected to said second end wall along the edge opposite the folding line for its respective bottom portion;

(g) a third top cover portion contiguous with and foldably connected to one of said side walls along a portion of the edge generally opposite the folding line for its respective bottom portion; and (h) means on said blank for enabling attachment of the various parts at selected locations when folded relative to one another to form an enclosure with a bottom, the parts being so dimensioned, configured and arranged that said second and third top cover portions overly one another to close a portion of said enclosure and said first top cover portion closes the other portion of said enclosure and wherein each of said overlying second and third top cover portions include a pair of aligned beverage container receiving openings.

12. The food container according to claim 11 wherein at least one of said second and third top cover portions includes means in said beverage container receiving opening for frictional engagement with the side of a beverage container therein.

13. The food container of claim 12 further including a second sheet member and wherein said second sheet member and said side walls include interlocking means for attachment of said second sheet member along a plane generally perpendicular to the bottom for dividing said enclosure into two compartments.

14. The food container of claim 13 wherein said second sheet member is formed of an insulating material.

15. The food container of claim 14 wherein said first top cover portion includes handle means with tab portions configured for engagement with at least some of said interlocking means to enable carrying of the food container.

16. The food container of claim 15 wherein said first top cover portion includes handle means, and wherein said second sheet member includes handle means, with the parts so dimensioned that each of said handle means is in abutting relation with the other with the first top cover portion folded to close the enclosure.

17. A food container comprising:

a first sheet of paperboard material formed in a blank and having a pair of generally identical side walls, a pair of generally rectangular end walls, a plurality of bottom portions configured for overlapping securement to form a bottom, and first, second and third top portions, all foldable relative to one another, and attachable at selected locations, to form an enclosure, at least one of said top portions including first handle means for carrying said food container;

a second sheet member, having a first end means attachable to opposite bottoms of said side walls in proximate relation to the bottom of said enclosure, said second sheet member having other means for attachment to said side walls adjacent the upper end thereof with said second sheet member extending in a direction generally perpendicular to said bottom for forming two compartments within said enclosure, two of said top portions being configured in rectangular form and overlying one of said compartments, with the other of said top portions overlying the other of said compartments, said second sheet member having second handle means for coaction with said first handle means of said other of said top portions for providing means for carrying said food container; and two of said top portions overly one another, with at least one beverage container receiving opening formed in each of said two top portions in aligned relationship upon overlying.

18. The food container of claim 17 wherein at least one of said two top portions includes means in said at least one beverage container receiving opening for frictional engagement with the side of a beverage container therein, and wherein said second sheet member is at least partially formed of an insulating material.

* * * * *